US006281633B1

(12) United States Patent
Lee et al.

(10) Patent No.: US 6,281,633 B1
(45) Date of Patent: Aug. 28, 2001

(54) PLASMA DISPLAY PANEL DRIVING APPARATUS

(75) Inventors: Eung Kwan Lee; Seong Ho Kang, both of Daeku (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/451,107

(22) Filed: Nov. 30, 1999

(30) Foreign Application Priority Data

Dec. 1, 1998 (KR) ..... 98-52165
Nov. 26, 1999 (KR) ..... 99-53186

(51) Int. Cl.[7] ..... G09G 3/10
(52) U.S. Cl. ..... 315/169.1; 315/169.3; 345/55; 345/76
(58) Field of Search ..... 315/169.3, 169.1, 315/169.2; 345/55, 76

(56) References Cited

U.S. PATENT DOCUMENTS 4,914,353 * 4/1990 Harada et al. ..... 315/169.3

FOREIGN PATENT DOCUMENTS 11-352916 12/1999 (JP) .

OTHER PUBLICATIONS

"Photo–Coupler and Application Thereof" pp. 189–191 of Optoelectronics.

"Application Thereof for Technical Engineers" laid open by Keigai Publishing Co. on Jan. 30, 1984.

* cited by examiner

*Primary Examiner*—David Vu
(74) *Attorney, Agent, or Firm*—Fleshner & Kim, LLP

(57) ABSTRACT

A plasma display panel driving apparatus that is capable of reducing the number of optical conductive devices. In the plasma display panel driving apparatus, a first controller generates control data for controlling the driving integrated circuits. A second controller drives the first controller. An optical conductive device for transmitting a light signal from the second control to the first control.

12 Claims, 8 Drawing Sheets

PLASMA DISPLAY PANEL DRIVING APPARATUS

BACKGROUND OF THE INVENTION

1. Field of the Invention

This invention relates to a driving apparatus for a plasma display panel, and more particularly to a plasma display panel driving apparatus that is capable of reducing the number of optical conductive devices.

2. Description of the Related Art

Generally, a plasma display panel (PDP) radiates a fluorescent body by an ultraviolet with a wavelength of 147 nm generated during a discharge of HE+Xe gas to thereby display a picture including characters and graphics. Such a PDP is easy to be made into a thin-film and large-dimension type. Moreover, the PDP provides a very improved picture quality owing to a recent technical development. The PDP is largely classified into a direct current (DC) driving system and an alternating current (AC) driving system.

The PDP of AC driving system is expected to be highlighted into a future display device because it has advantages in the low voltage drive and a prolonged life in comparison to the PDP of DC driving system. Also, the PDP of alternating current driving system allows an alternating voltage signal to be applied between electrodes having dielectric layer therebetween to generate a discharge every half-period of the signal, thereby displaying a picture. The AC-type PDP makes a memory effect because it uses a dielectric material into the surface of which a wall charge is accumulated during the discharge.

Referring to FIG. 1 and FIG. 2, the AC-type PDP includes a front substrate 1 provided with sustaining electrodes 10, and a rear substrate 2 provided with address electrodes 4. The front substrate 1 and the rear substrate 2 are spaced, in parallel to each other, with having a barrier rib 3 therebetween. A mixture gas such as Ne—Xe or He—Xe, etc. is injected into a discharge space defined by the front substrate 1 and the rear substrate 2 and the barrier rib 3. These sustaining electrodes 10 make a pair by two within a single plasma discharge channel. One of a pair of sustaining electrodes 10 is used as a scanning/sustaining electrode that responds to a scanning pulse applied in the address interval to cause an opposite discharge along with the address electrodes 4, and responds to a sustaining pulse applied in the sustaining interval to cause a surface discharge along with the adjacent sustaining electrodes 10. Also, the sustaining electrodes 10 adjacent to the sustaining electrode 10 used as the scanning/sustaining electrode 10 used as a common sustaining electrode to which a sustaining pulse is applied commonly. On a front substrate 1 provided with the sustaining electrodes 10, a dielectric layer 8 and a protective layer 9 are disposed. The dielectric layer 8 and a responsible for limiting a plasma discharge current as well as accumulating a wall charge during the discharge. The protective film 9 prevents a damage of the dielectric layer 8 caused by a sputtering generated during the plasma discharge and improves an emission efficiency of secondary electrons. This protective film is usually made from MgO. Barrier ribs 3 for dividing the discharge space is extended perpendicularly at the rear substrate 2. On the surfaces of the rear substrate 2 and the barrier ribs 3, there is provided a fluorescent layer 5 excited by a vacuum ultraviolet lay to generate a visible light.

As shown in FIG. 3, the PDP 20 has m×n discharge pixel cells 11 arranged in a matrix pattern. At each of the discharge pixel cells 11, scanning/sustaining electrode lines Yl to Ym, hereinafter referred to as "Y electrode lines", and common sustaining electrode lines Z1 to Zm electrode lines Xl to Xn, hereinafter referred to as "electrode lines " are crossed with respect to each other. The Y electrode lines Y1 to Ym and the Z electrode lines Z1 to Zm consist of the sustaining electrodes 10 making a pair. The X electrode lines X1 to Xn consist of the address electrodes 4.

FIG. 3 is a schematic view of a PDP driver shown in FIG. 1. In FIG. 3, the PDP driver includes a scanning/sustaining driver 22 for driving the Y electrode lines Y1 to Ym, a commons sustaining driver 24 for driving the Z electrode lines Z1 to Zm, and first and second address drivers 26A and 26B for driving the X electrode lines X1 to Xn. The scanning/sustaining driver 22 is connected to the Y electrode lines Y1 to Ym to thereby select a scanning line to be displayed and generate a sustaining discharge at the selected scanning line. The common sustaining driver 24 is commonly connected to the Z electrode lines Z1 to Zm to apply sustaining pulses with same waveform to all the Z electrode lines Z1 to Zm, thereby causing the sustaining discharge. The first address driver 26A supplies odd-numbered X electrode lines X1, X3, . . . , Xn-3, Xn-1 with a video data, whereas the second address driver 26B supplies even-numbered X electrode lines X2, X4, . . ., Xn-2, Xn with a video data.

In such a PDP, one frame consists of a number of sub-fields so as to realize gray levels by a combination of the sub-fields. For instance, when it is intended to realize 256 gray levels, one frame interval is time-divided into 8 sub-fields. Further, each of the 8 sub-fields is again divided into a reset interval, an address interval and a sustaining interval. In the reset interval, the entire field is initialized. In the address interval, the discharge pixel cells 11 to be displayed by a data are selected by the address discharge. The selected discharge pixel cells 11 sustain the discharge in the sustaining interval. The sustaining interval is lengthened by an interval corresponding to $2^n$ depending on a weighting value of each sub-field. In other words, the sustaining interval involved in each of first to eight sub-fields is lengthened at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$ depending on the sub-fields . The brightness and the chrominance of a displayed image are determined in accordance with a combination of the sub-fields.

A method of driving a PDP is largely classified into an address display separated (ADS) system in which the entire field is divided into an address interval and a sustaining interval, and an address while sustaining (AWS) system in which one field is divided into a number of blocks and an address interval and a sustaining interval coexist within one field.

FIG. 4 is a block diagram showing the configuration of a PDP driving apparatus of ADS system emphasized on the scanning/sustaining driver. In FIG. 4, the PDP driving apparatus of ADS system includes a PDP 20 having 480 Y electrode lines Y1 to Y480, a scanning/sustaining driver 30 for driving the Y electrode lines Y1 to Y480 sequentially, photo-couplers 32A to 32D for transmitting a control data Cdata generated from a microcomputer 34 and common control signals CC1 to CC3 to the sustaining driver 30, and first and second waveform generators 36A and 36B for applying a scanning pulse and a sustaining pulse to the sustaining driver 30. The sustaining driver 30 consists of first to eighth driver integrated circuits (ICs) 30A to 30H to the first photo-coupler 32A in cascade. Each of the driver ICs 30A to 30H responds to the control data Cdata from the first photo-coupler 32A to driver 60 Y electrode lines sequentially. In other words, the driver ICs 30A to 30H respond to the control data Cdata to be sequentially driven, thereby applying a scanning pulse to the first Y electrode line Yl to the 480th Y electrode line Y480 sequentially in the address interval. The driver ICs 30A to 30H respond to the common control signals CC1 to CC3 at the moment of transiting from the address interval into the sustaining interval to drop voltages at the 480 Y electrodes Y1 to Y480 simultaneously into a ground level, and thereafter apply a sustaining pulse to the Y electrode lines Y1 to Y480 commonly in the sustaining interval. The first photo-coupler 32A compensates for a ground level of the microcomputer 34 and a ground level of the scanning/sustaining driver different from each other to apply the control data Cdata from the microcomputer 34 to the first driver IC 30A. Likewise, the second to fourth photo-couplers 32B to 32D compensate for a ground level of the microcomputer 34 and a ground level of the scanning/sustaining driver 30 different from each other to apply a control data Cdata from the microcomputer 34 to control terminals of the sustaining driver 30. To this end, the photo-couplers 32A to 32D are insulated between the input and the output thereof, and deliver an input signal to the output in a shape of light signal. As shown in FIG. 5, the photo-couplers 32A to 32D include a photo diode PD connected between the microcomputer 34 and a primary ground voltage source GND1, and a photo transistor PT connected between a secondary voltage supply VCC2 and a secondary ground voltage source GND2. The phototransistor PD is radiated in accordance with an output signal of the microcomputer 34 applied from a first resistor R1 for limiting a current to generate a light. The NPN-type photo transistor PT applies a control data Cdata having a contrary phase with respect to an output signal of the microcomputer 34 or the common control signals CC1 to CC3 to the driver ICs 30A to 30H in an incidient light from the photo diode PD received to its gate terminal. A second resistor R2 is connected between a collector terminal of the phototransistor PT and a secondary common voltage source VCC2 coupled with the driver ICs 30A to 30D. The first and second waveform generators 36A and 36B play a role to apply high-level voltages and low-level voltages of the scanning pulse and the sustaining pulse to the scanning/sustaining driver 30, respectively. The PDP driving apparatus of ADS system uses one photo-coupler for supplying a control data and three to fifth photo-coupler for supplying common control signals.

FIG. 6 is a block diagram showing the configuration of a PDP driving apparatus of AWS system emphasized on the scanning/sustaining driver. In FIG. 6, the PDP driving apparatus of AWS system includes a PDP 20 having 480 Y electrode lines Y1 to Y480, a scanning/sustaining driver 40 for making a divisional driving of 60 lines of the Y electrode lines Y1 to Y480, photo-couplers 42A to 42K for transmitting control data Cdata1 to Cdata8 from a microcomputer 44 and common control signals CC1 to CC3 to the sustaining driver 40, and first and second waveform generators 46A and 46B for applying a scanning pulse and a sustaining pulse to the sustaining driver 40. The sustaining driver 40 consists of first to eight driver ICs 40A to 40H connected to each of the photo-couplers 42A to 42K in serial. Each of the driver ICs 40A to 40H responds to the control data Cdata1 to Cdata8 in such a manner that each block on the field including 60 scanning lines is addressed or sustained independently, thereby driving 60 Y electrode lines independently. In other words, each of the driver ICs 40A to 40H responds to the control data Cdata1 to Cdata8 to be driven independently, thereby applying a scanning pulse from the first and second waveform generators 46A and 46B to the Y electrode lines Y1 to Y480. The driver ICs 40A to 40H respond to the common control signals CC1 to CC3 at the moment of transisting from the address interval into the sustaining interval to drop voltages at the 480 Y electrodes Y1 to Y480 simultaneously into a ground level, and thereafter apply sustaining pulses from the first and second waveform generators 46A and 46B to the Y electrode lines Y1 to Y480 commonly in the sustaining interval. The photo-couplers 42A to 42K compensate for a ground level of the microcomputer 44 and a ground level of the scanning/sustaining driver 40 different from each other to apply the control data Cdata1 to Cdata8 from the microcomputer 34 and the common control signals CC1 to CC3 to the scanning/sustaining driver 40. As shown in FIG. 5, each of the photo-couplers 42A to 42D consists of a photo diode PD and an photo transistor PT that are separated from each other to transmit a light signal. The first and second waveform generators 36A and 36B play a role to apply high-level voltages and low-level voltages of the scanning pulse and the sustaining pulse, respectively, under control of the microcomputer 34. On the other hand, a common sustaining driver for driving the Z electrode lines for each block also consists of a plurality of driver ICs and photo-couplers. For instance, the PDP driving apparatus of AWS system typically uses 16 to 32 photo-couplers.

As described above, the conventional PDP driving apparatus must have a number of photo-couplers 32A to 32D or 42A to 42K so as to apply control data from the microcomputer 34 or 44 or common control signals to the driver ICs 30A to 30H or 40A to 40H by compensating for ground levels of the microcomputers 34 or 44 and the driver ICs 30A to 30H or 40A to 40H. Furthermore, as the number of photo-couplers 32A to 32D or 42A to 42K is larger, the number of output lines in the microcomputer 34 or 44 becomes larger. Accordingly, the conventional PDP driving apparatus causes a cost rise as well as a complicate driving circuit due to a number of photo-couplers 32A to 32D or 42A to 42K and a number of signal wiring.

SUMMARY OF THE INVENTION

Accordingly, it is an object of the present invention to provide a PDP driving apparatus that is capable of reducing the number of optical conductive devices.

In order to achieve these and other objects of the invention, a PDP driving apparatus according to one aspect of the present invention includes first control means for producing control data for controlling the driving integrated circuits; second control means for driving the first control means; and an optical conductive device for transmitting a light signal from the second control means to the first control means.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
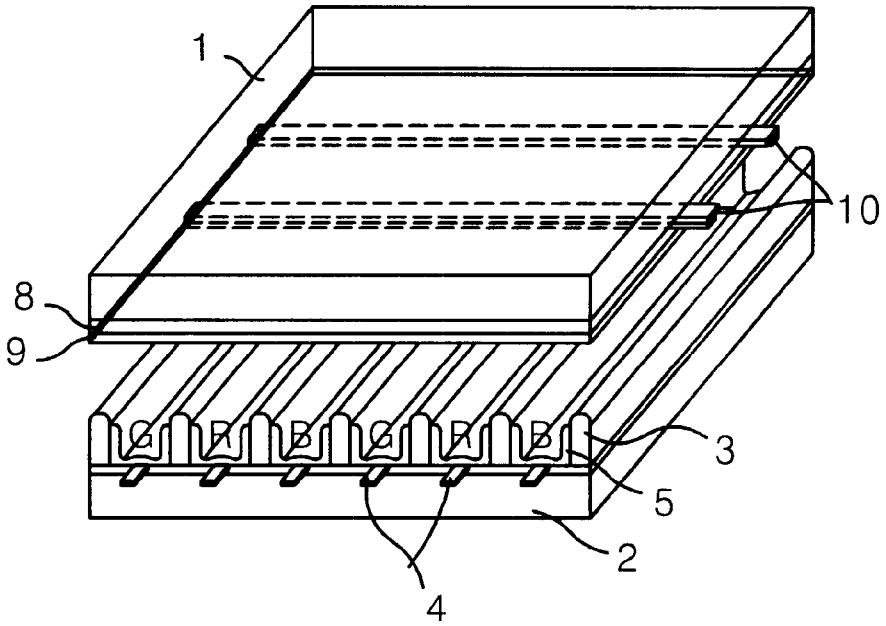
FIG. 1 PRIOR ART
FIG. 1 is a perspective view showing the structure of a conventional three-electrode, AC-type plasma display panel.
Figure 2:
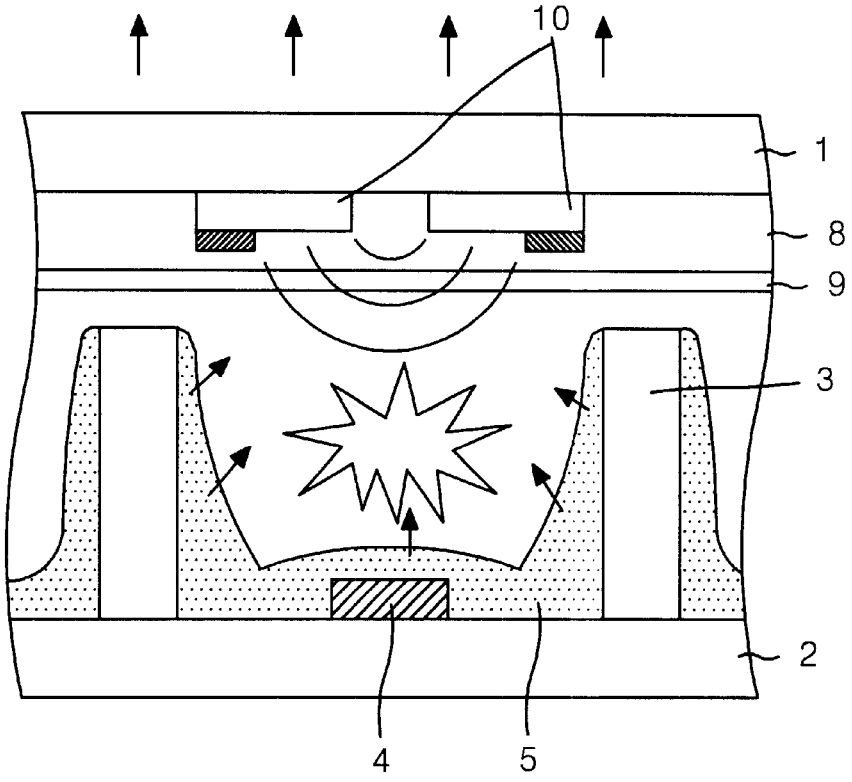
FIG. 2 PRIOR ART
FIG. 2 is a sectional view showing the structure of a single discharge pixel cell in the plasma display panel in FIG. 1.
Figure 3:
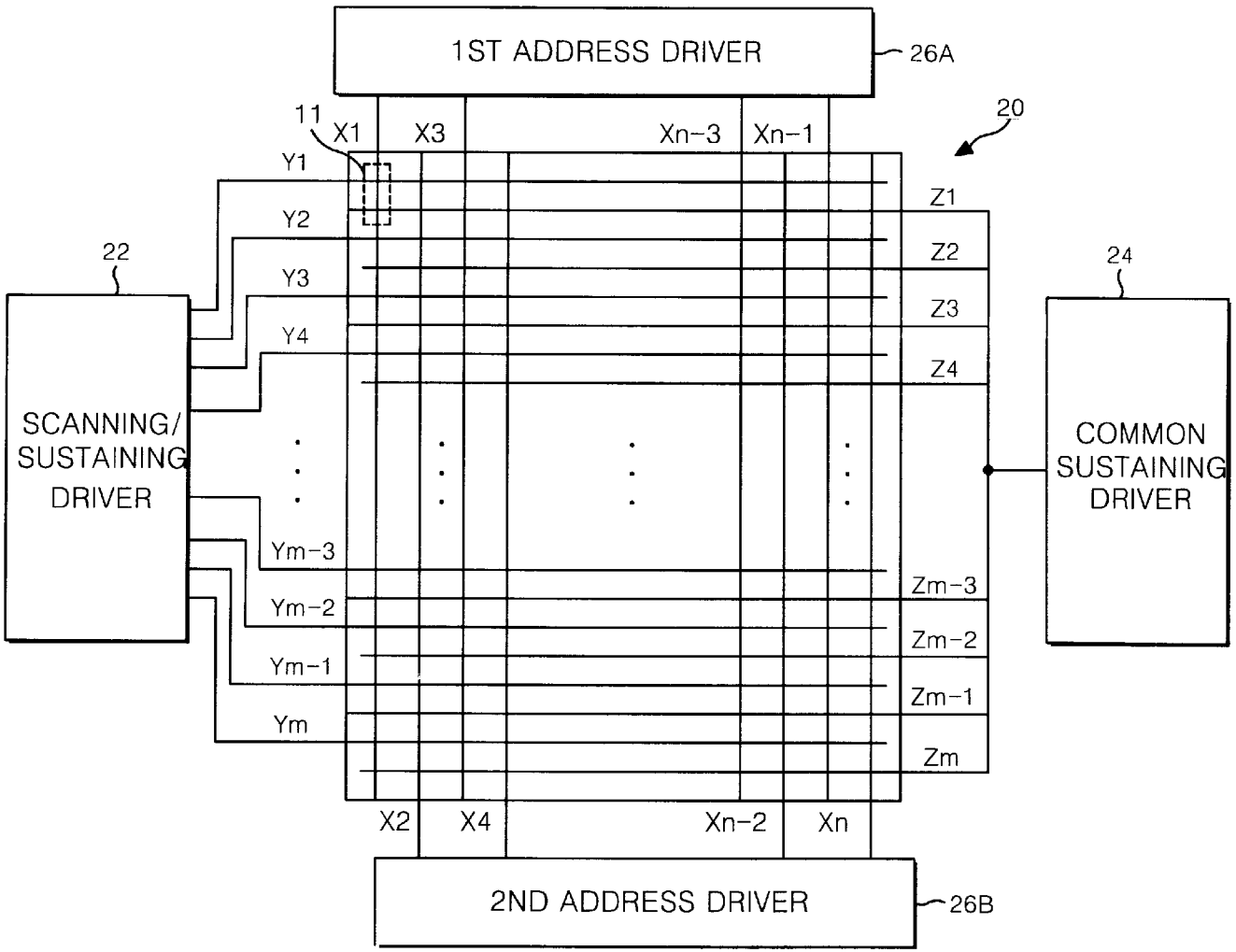
FIG.3 PRIOR ART
FIG. 3 is a schematic plan view showing the plasma display panel in FIG. 1 and a driving apparatus thereof.
Figure 4:
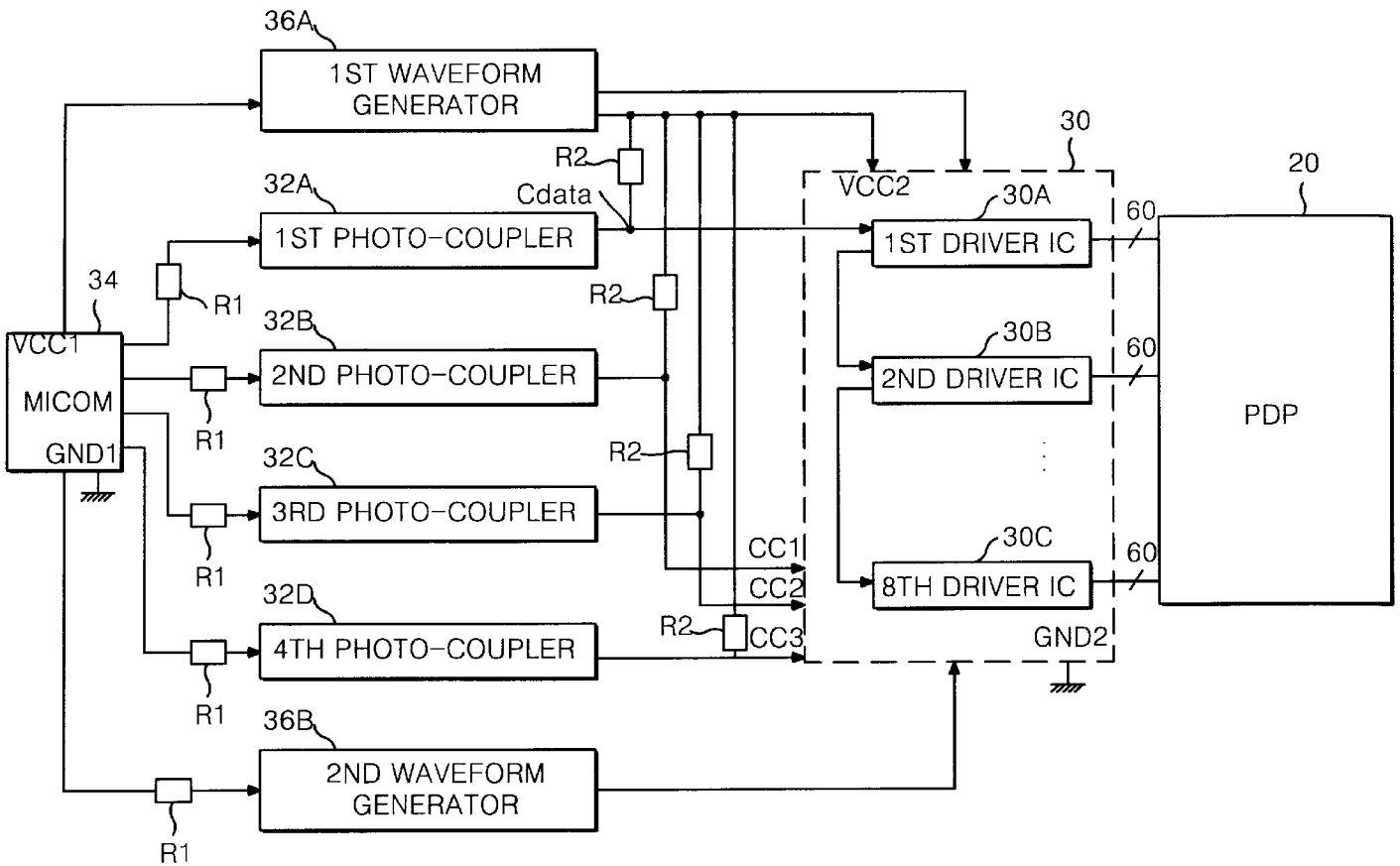
FIG. 4 PRIOR ART
FIG. 4 is a schematic block diagram showing the configuration of a conventional PDP driving apparatus of ADS system.
Figure 5:
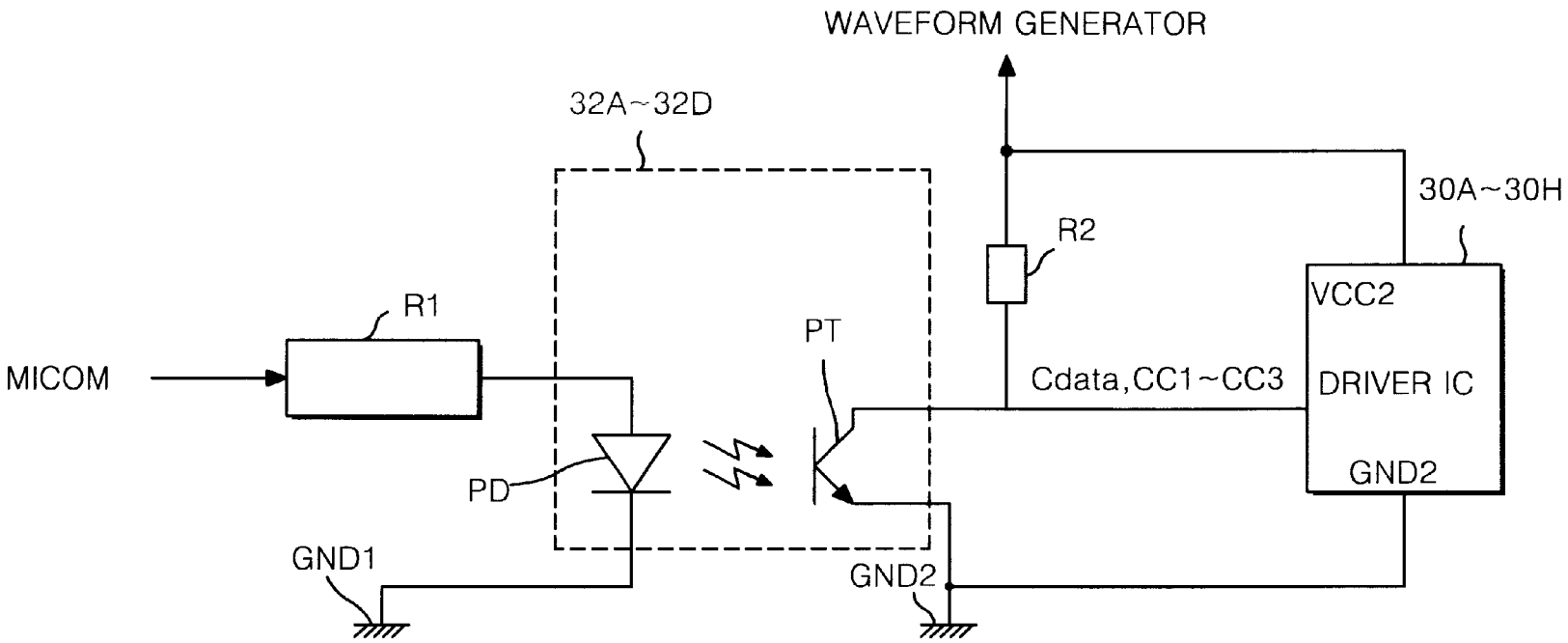
FIG. 5 PRIOR ART
FIG. 5 is an equivalent circuit diagram of the photo-coupler shown in FIG. 4.
Figure 6:
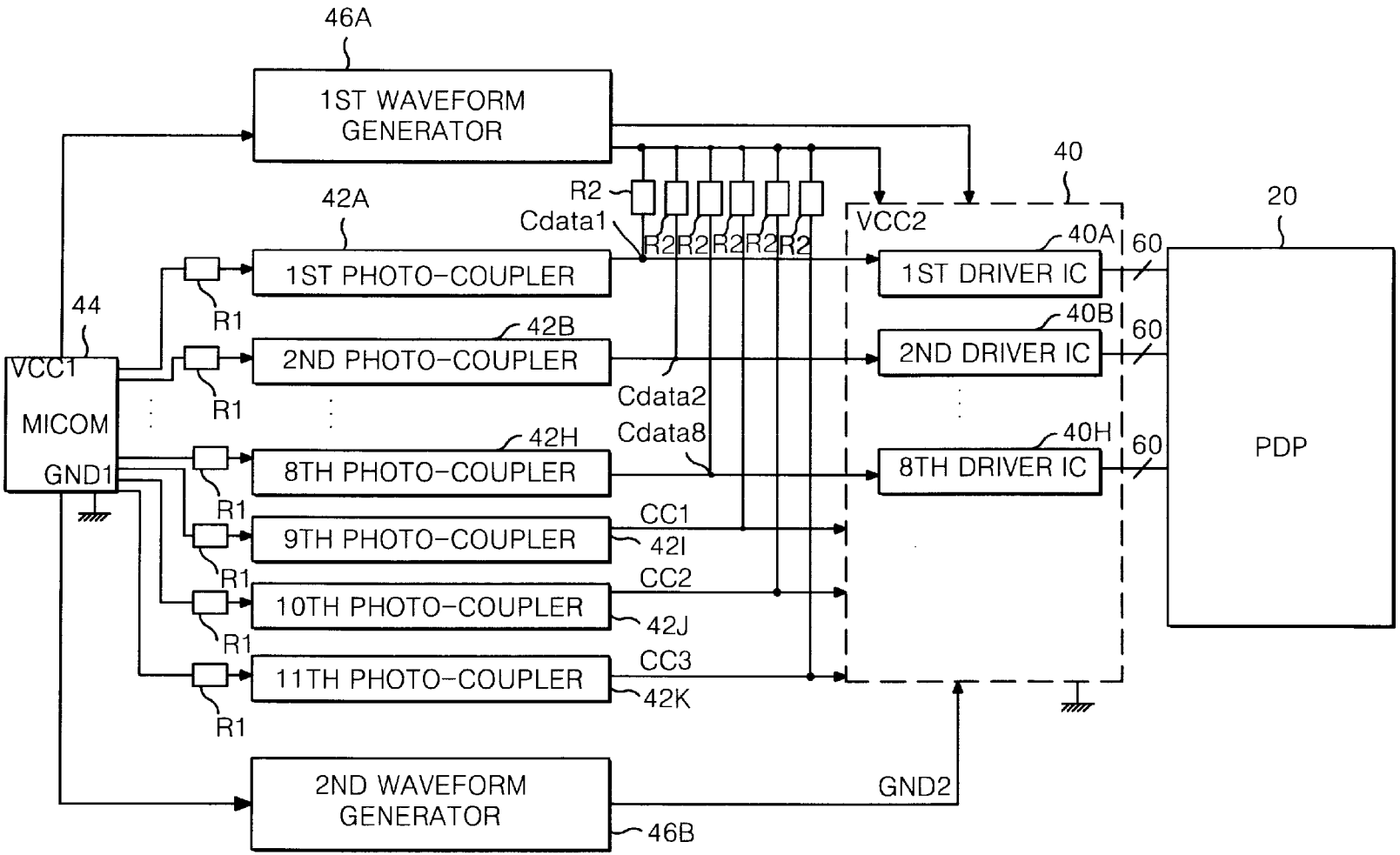
FIG.6 PRIOR ART
FIG. 6 is a schematic block diagram showing the configuration of a conventional PDP driving apparatus of AWS system.
Figure 7:
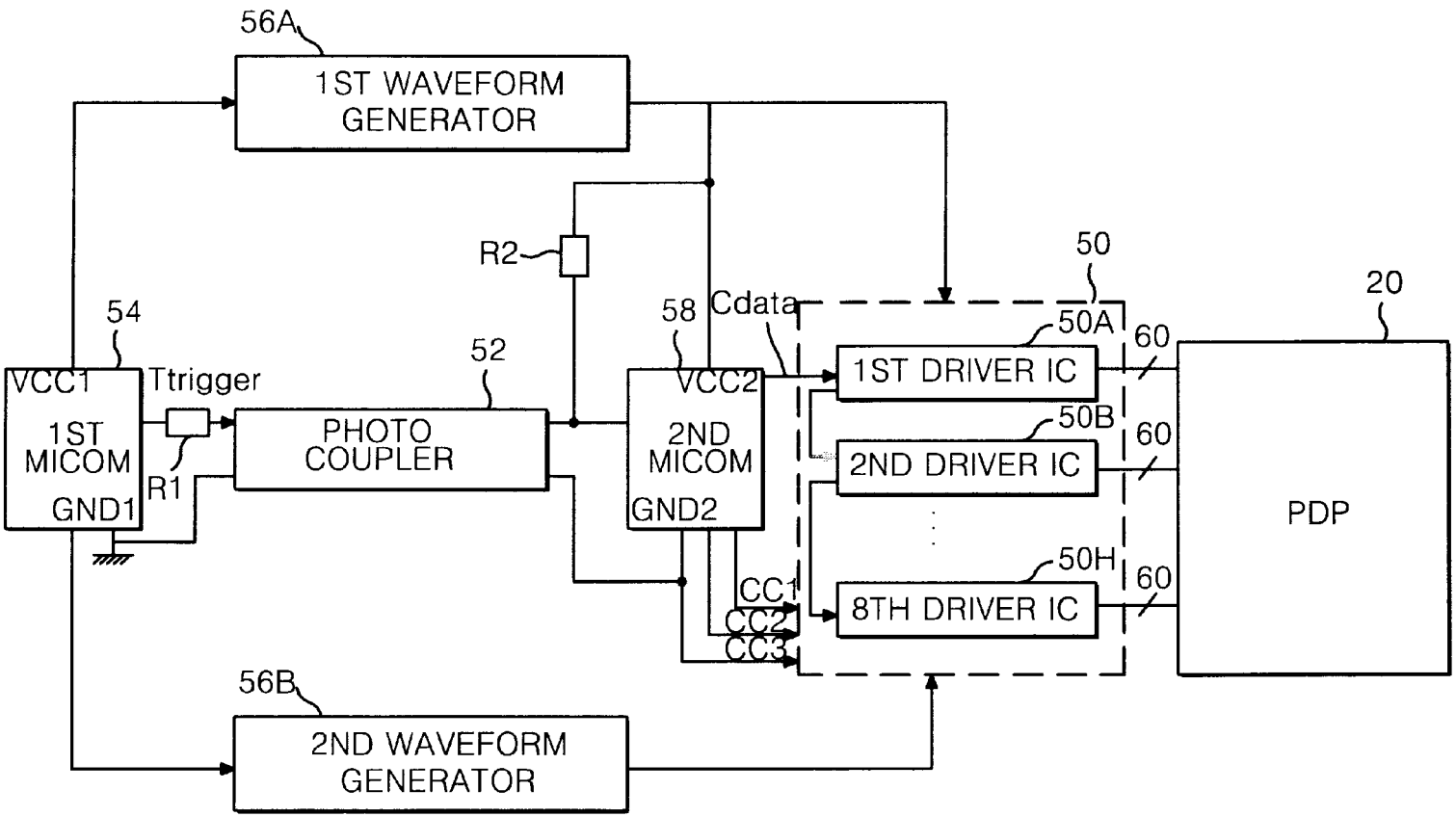
FIG. 7 is a schematic block diagram showing the configuration of a PDP driving apparatus of ADS system according to an embodiment of the present invention.

Referring to FIG. 7, there is shown a plasma display panel (PDP) driving apparatus of ADS system according to an embodiment of the present invention which is emphasized on a scanning/sustaining driver. The PDP driving apparatus of ADS system includes a PDP 20 having 480 Y electrode lines Y1 to Y480, a scanning/sustaining driver 50 for driving the Y electrode line Y1 to Y480 sequentially, A first microcomputer 54 for generating a timing trigger signal, a second microcomputer 58 for responding to the trigger signal to generate a control data Cdata and common control signals CC1 to CC3, a photo-coupler 52 for transmitting the timing trigger signal from the first microcomputer 54 to the second microcomputer 58, and first and second waveform generator 56A and 56B for applying a scanning pulse and a sustaining pulse to the sustaining driver 50. The sustaining driver 50 consists of first to eight ICs 50A to 50H connected in cascade, to the second microcomputer 58. Each of the driver ICs 50A to 50H responds to a control data Cdata from the second microcomputer 58 to drive 60 Y electrode lines sequentially. In other words, the driver ICs 50A to 50H respond to the control data to be sequentially driven, thereby applying a scanning pulse to the first to 480th Y electrode line Y1 to Y480 sequentially in the address interval. The driver ICs 50A to 50H respond to the common control signals CC1 to CC3 at the moment of transiting from the address interval in the sustaining interval to drop voltages at the 480 Y electrode lines Y1 to Y480 into a ground level, and thereafter apply a sustaining pulse to the Y electrode lines Y1 to Y480 commonly in the sustaining interval. A ground voltage GND2 of the second microcomputer 58 is set in the same value as those of driver ICs 50A to 50H. Accordingly, since ground levels of the driver ICs 50A to 50H are set in compliance with the sustaining voltage, a ground level of the first microcomputer 54 also is set to have a high value. For instance, a ground level of the first microcomputer 54 and a supply voltage VCC1 are 0V and 5V, respectively, whereas a ground level of the second microcomputer 58 and a supply voltage VCC2 may be set to 20V and 25V, respectively. The photo-coupler 52 is connected, via a first resistor R1, to the first microcomputer 54 and, at the same time, is connected, via a second resistor R2, to a voltage supply VCC2 of the second microcomputer 58. The photo-coupler 52 compensates for ground levels of the first and second microcomputers 54 and 58 different from each other to apply a timing trigger signal from the first microcomputer 54 to the second microcomputer 58. As shown in FIG. 5, the photo-coupler 52 consists of a photo diode PD at the input thereof and a phototransistor PT that are electrically insulated. A collector terminal of the phototransistor PT is connected, via the second resistor R2, to an output terminal of the first waveform generator 56A and the voltage supply VCC2 of the second microcomputer 58. An emitter terminal of the phototransistor PT is connected to an output terminal of the second waveform generator 56A and the second voltage supply VCC2 of the second microcomputer 58. The voltage supply VCC2 applied to the second microcomputer 58 from the photo-coupler 52 and the ground voltage GND2 maintain a voltage difference of 5V like the first microcomputer. Since a collector voltage and an emitter voltage of the photo transistor 58 change in a similar manner even when an alternating current (AC) pulse signal is generated from the first and second waveform generators 56A and 56B, the voltage supply VCC1 of the second microcomputer 58 and the ground voltage GND2 always remains at 5V. The second microcomputer 58 supplies the control data Cdata to the first driver IC 50A and, at the same time, supplies the common control signals CC1 to CC3 to common terminals of the driver ICs 50A to 50H in accordance with a timing trigger signal from the photo coupler 52. The first and second waveform generators 56A and 56M apply high-level voltages and low-level voltages of the scanning pulse and the sustaining pulse, respectively, to the scanning/sustaining driver 50 under control of the first microcomputer 54.

Figure 8:
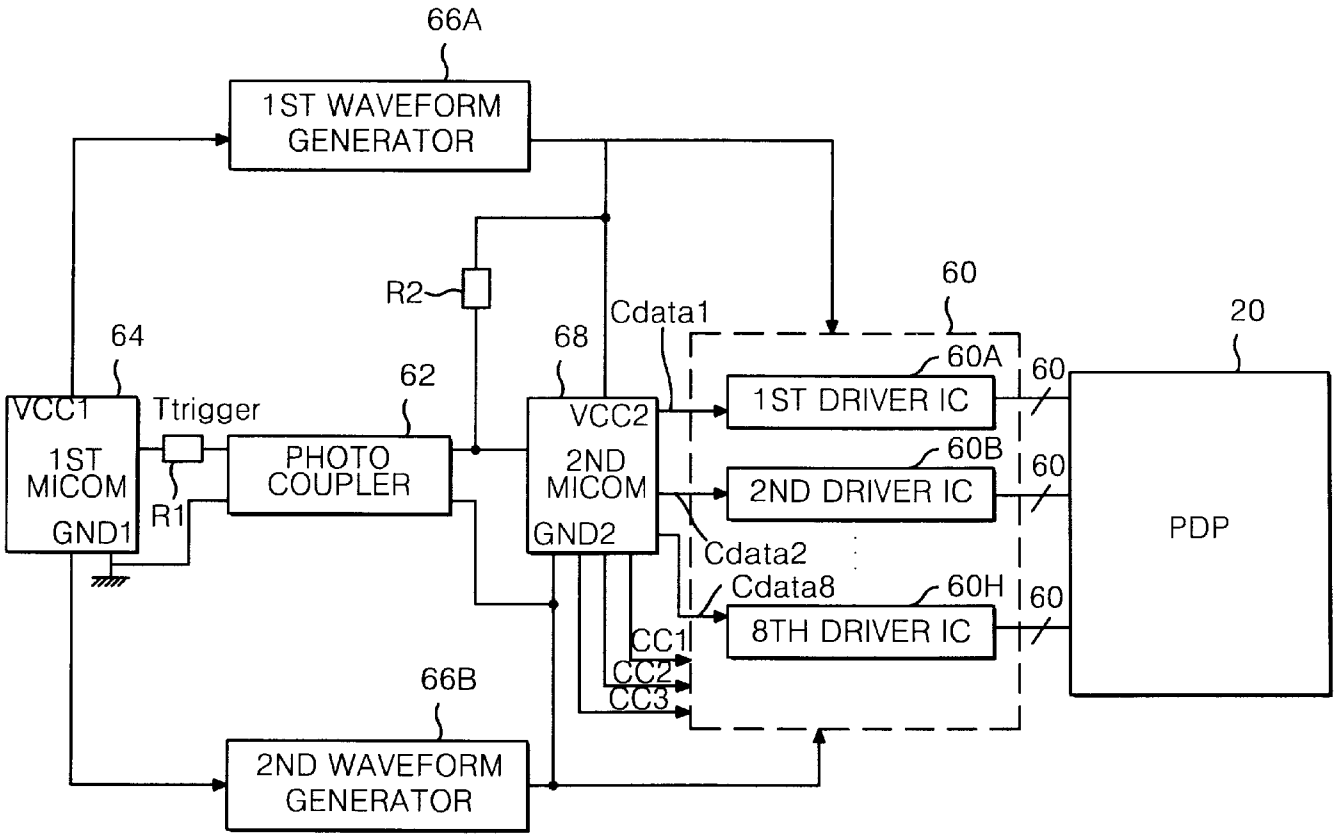
FIG. 8 is a schematic block diagram showing the configuration of A PDP driving apparatus of AWS system according to an embodiment of the present invention.

Referring to FIG. 8, there is shown a PDP driving apparatus of AWS system according to an embodiment of the present invention, which is emphasized, on a scanning/sustaining driver. The PDP driving apparatus of AWS system includes a PDP 20 having 480 Y electrode lines Y1 to Y480, a scanning/sustaining driver 60 for making a divisional driving of 60 lines of the Y electrode lines Y1 to Y480, a first microcomputer 64 for generating a timing trigger signal, a second microcomputer 68 for responding to the timing trigger signal to generate a control data Cdata and common control signals CC1 to CC3, a photo-coupler 62 for transmitting the timing trigger signal from the first microcomputer 65 to the second microcomputer 68, and first and second waveform generators 66A and 66B for applying a scanning pulse and a sustaining pulse to the sustaining driver 60. The sustaining driver 60 consists of first to eighth driver ICs 60A to 60H connected, in serial, to the output terminal of the second microcomputer 68. Each of the driver ICs 60A to 60H responds to a control data Cdata from the second microcomputer 58 to driver 60 Y electrode lines sequentially. In other words, the respective driver ICs 50A to 50H respond to control data Cdata1 to Cdata 8 in such a manner that each block in the field including 60 scanning lines can be addressed and sustained independently, thereby driving 60 Y electrode lines independently. In other words, the respective driver ICs 60A to 60H respond to the control data Cdata1 to Cdata8 to be driven independently, thereby applying a scanning pulse to the Y electrode lines Y1 to Y480 in the address interval. The driver ICs 60A to 60H respond to the common control signals CC1 to CC3 at the moment of transiting from the address interval into the sustaining interval to drop voltages at the 480 Y electrode lines Y1 to Y480 into a ground level simultaneously, and thereafter apply a sustaining pulse to the Y electrode lines Y1 to Y480 commonly in the sustaining interval. A ground voltage GND2 of the second microcomputer 58 is set in the same value as those of the driver ICs 60A to 60H. Accordingly, since ground levels of the driver ICs 60A to 60H are set in compliance with the sustaining voltage, a ground level of the second microcomputer 68 also is set to have a high value. The photo-coupler 62 is connected, via a first resistor R1, to the first microcomputer 64 and, at the same time, is connected, via a second resistor R2, to a voltage supply VCC2 of the second microcomputer 68. The photo-coupler 62 compensates for ground levels of the first and second microcomputers 64 and 68 different from each other to apply a timing trigger signal from the first microcomputer 64 to the second microcomputer 68. As shown in FIG. 5, the photo-coupler 52 consists of a photo diode PD at the input thereof and a phototransistor PT that are electrically insulated. The voltage supply VCC2 applied to the second microcomputer 68 from the photo-coupler 62 and the ground voltage GND2 maintain a voltage difference of 5V like the first microcomputer 64. The second microcomputer 68 supplies the control data CData1 to Cdata8 to the driver ICs 60A to 60H, respectively and, at the same time, supplies the common control signals CC1 to CC3 to common terminals of the driver ICs 60A to 60H in accordance with a timing trigger signal from the photo coupler 52. The first and second waveform generators 66A and 66B apply high-level voltages and low-level voltages of the scanning pulse and the sustaining pulse, respectively, to the scanning/sustaining driver 60 under control of the first microcomputer 65.

As described above, the PDP driving apparatus according to the present invention is provided with the microcomputers having the same ground level as those of the driver ICs and controlling the driver ICs directly. In the PDO driving apparatus, the optical conductive device for compensating for a ground level difference between two microcomputers with a different ground level to transmit a signal is installed between the two microcomputers.

Accordingly, the PDP driving apparatus according to the present invention can minimize the number of optical conductive devices by providing a single optical conductive device between two microcomputers with a different ground level instead of removing a number of optical conductive devices installed between the microcomputer and the driver ICs. Also, since the number of optical conductive devices installed between the microcomputer and the driver ICs is reduced, the number of output terminals of the microcomputer and signal wiring can be reduced to that extent. As a result, the PDP driving apparatus according to the present invention is capable of lowering the cost as well as simplifying the driving circuit.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a plasma display panel including a plurality of driving integrated circuits for driving electrodes installed on the panel, comprising:

first control means for producing control data for controlling the driving integrated circuits;

second control means for driving the first control means, and an optical conductive device for transmitting a light signal from the second control means to the first control means.

2. The driving apparatus as claimed in claim 1, wherein a ground level of the first control means is different from that of the second control means.

3. The driving apparatus as claimed in claim 1, wherein a ground level of the first control means is identical to those of the driving integrated circuits.

4. The driving apparatus as claimed in claim 1, further comprising:

waveform generating means for applying high-level voltages and low-level voltages of a scanning pulse and a sustaining pulse to the driving integrated circuits under control of the second control means.

5. The driving apparatus as claimed in claim 4, wherein the driving integrated circuits respond to the control data to apply the scanning pulse and the sustaining pulse to the electrodes.

6. The driving apparatus as claimed in claim 1, wherein the second control means generates a trigger signal for driving the first control means.

7. The driving apparatus as claimed in claim 6, wherein the optical conductive device transmits the trigger signal from the second control means to the first control means.

8. The driving apparatus as claimed in claim 1, wherein the control data from the first control means is applied to any one of the driving integrated circuits to drive the driving integrated circuits sequentially.

9. The driving apparatus as claimed in claim 1, wherein the control data from the first control means is applied to each of the driving integrated circuits to drive the driving integrated circuits for each block in the panel.

10. The driving apparatus as claimed in claim 1, wherein the first control means generates common control signals for controlling the driving integrated circuits commonly.

11. The driving apparatus as claimed in claim 1, wherein the optical conductive device is a photo-coupler.

12. The driving apparatus as claimed in claim 1, wherein a single one of the optical conductive device is installed between the first control means and the second control means.

* * * * *